US008293024B2

(12) United States Patent
Jerg et al.

(10) Patent No.: US 8,293,024 B2
(45) Date of Patent: Oct. 23, 2012

(54) DISHWASHER

(75) Inventors: Helmut Jerg, Giengen (DE); Kai Paintner, Adelsried (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 2097 days.

(21) Appl. No.: 10/564,230

(22) PCT Filed: Jul. 5, 2004

(86) PCT No.: PCT/EP2004/007337

§ 371 (c)(1),
(2), (4) Date: Jan. 10, 2006

(87) PCT Pub. No.: WO2005/018409

PCT Pub. Date: Mar. 3, 2005

(65) Prior Publication Data

US 2006/0278257 A1 Dec. 14, 2006

(30) Foreign Application Priority Data

Jul. 30, 2003 (DE) ..... 103 34 790
Nov. 18, 2003 (DE) ..... 103 53 774

(51) Int. Cl.
*B08B 3/04* (2006.01)

(52) U.S. Cl. ..... 134/25.2; 134/18; 134/25.1; 134/56 D; 134/57 D; 134/58 D

(58) Field of Classification Search ..... 134/56 D, 134/58 D, 18, 25.1, 25.2, 57 D
See application file for complete search history.

(56) References Cited

U.S. PATENT DOCUMENTS 5,343,632 A * 9/1994 Dinh ..... 34/507
6,434,857 B1 8/2002 Anderson et al.

FOREIGN PATENT DOCUMENTS

| | | |
|---|---|---|
| DE | 2 016 831 | 10/1971 |
| DE | 36 26 887 | 2/1988 |
| EP | 0 358 279 | 3/1990 |
| EP | 358279 A1 * | 3/1990 |
| EP | 0 777 998 | 6/1997 |

OTHER PUBLICATIONS

Machine Translation of European Patent Application Publication No. 358279 A1 to Fried et al. Mar. 1990.*
International Search Report PCT/EP2004/007337, Sep. 2005.

* cited by examiner

*Primary Examiner* — Michael Barr
*Assistant Examiner* — Benjamin Osterhout
(74) *Attorney, Agent, or Firm* — James E. Howard; Andre Pallapies

(57) ABSTRACT

A dishwasher is provided that permits the efficient and economical cleaning and drying of the items to be washed in the washing container, whilst reducing the associated energy consumption. To achieve this, in addition to the washing container, the inventive dishwasher also comprises a sorption column, which is connected to the washing container to form an air-conductive link and contains a material that can be reversibly dehydrated, said sorption column being used at least partially to dry the washed items. The thermal energy that is applied in the desorption of the sorption column is used at least partially to heat the rinsing water and/or the washed items in the washing container.

2 Claims, 1 Drawing Sheet

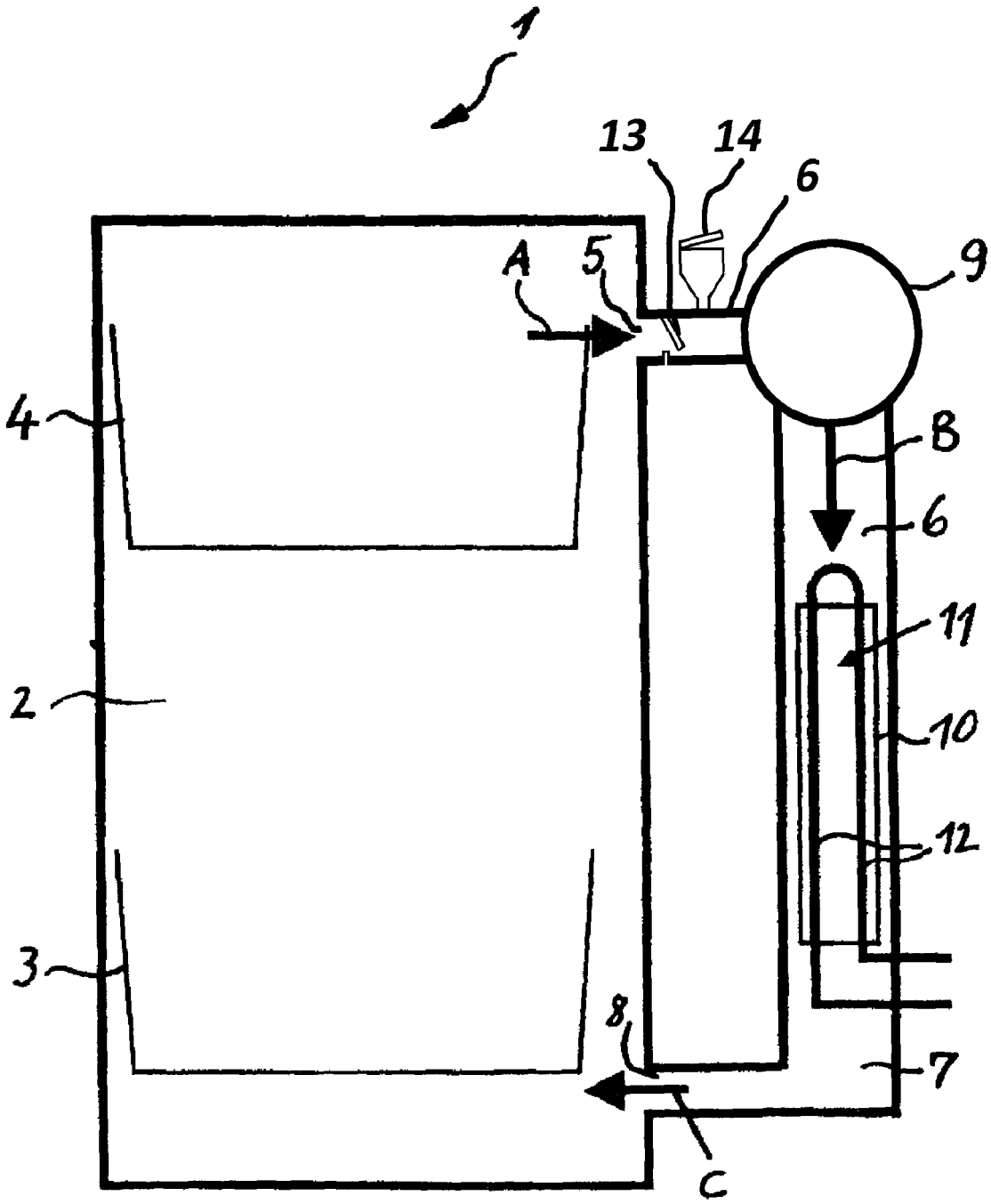
1
13
14
6
9
A
5
4
B
6
11
2
10
12
3
8
7
C

DISHWASHER

The invention relates to a dishwasher comprising a washing container and devices for washing crockery.

It is known that a dishwasher has a washing method whose program run consists of at least one partial program step "pre-rinse", a partial program step "clean", at least one partial program step "intermediate rinse", a partial program step "clear rinse" and a partial program step "dry". The rinsing liquid is heated before or after a partial program step to enhance the cleaning effect. The rinsing liquid is usually heated using electrical heaters. Various drying systems are known for drying objects to be washed in a dishwasher.

For example, the objects to be washed can be dried by own-heat drying if the rinsing liquid is heated in a partial program step "clear rinse" and thus the objects to be washed which have undergone a hot clear rinse are dried by themselves by the self-heat of the objects to be washed which has thus built up during the drying process. In order to achieve this own-heat drying, the rinsing liquid is heated to a certain temperature in a heat exchanger in the "clear rinse" partial program step and applied to the objects to be washed by means of spraying devices. As a result of the relatively high temperature of the rinsing liquid in the "clear rinse" partial program step of usually 65° C. to 75° C., it is achieved that a sufficiently large quantity of heat is transferred to the objects to be washed so that water adhering to said objects to be washed vaporises as a result of the heat stored in the objects to be washed.

In a further known drying device, a separate heat source, e.g. a hot air fan, is used in the washing container to heat the moist air mixture during the drying process so that the air in the washing container can absorb a larger quantity of moisture.

Dishwashers are known in which the moist air is vented outwards. This is disadvantageous since the surrounding kitchen furniture is damaged.

Thus, further dishwashers are known in which the moist air is passed over condensing surfaces on which the moisture condenses before being guided out. This condensation is either passed into the washing container or into special collecting containers.

A dishwasher of the type specified initially is known from DE 20 16 831 wherein the air from the washing container is guided via a closable opening in the wall of the washing container onto reversibly dehydratable material and from there outwards via an opening. The desorption of the reversibly dehydratable material takes place during the standstill phase of the appliance wherein the water vapour produced is guided outwards again via the opening. As has already been explained above, this is disadvantageous since the surrounding kitchen furniture is damaged.

A disadvantage in the heating systems described above according to the prior art described further above is that the heating of the rinsing liquid is associated with a high energy requirement and the thermal energy required for each heating phase must be produced anew by means of electrical heating elements. The known heating systems also have the disadvantage that the heating of the rinsing liquid in the "clear rinse" partial program step and the processes in the "drying" partial program step are themselves associated with a high energy requirement and the thermal energy required is lost after the drying process.

It is thus the object of the present invention to provide a dishwasher which can be used to efficiently and economically clean and dry items to be washed in the washing container and to keep the associated energy expenditure as low as possible.

This object is solved by the dishwasher according to the invention having the features according to claim 1. Advantageous further developments of the present invention are characterised in the dependent claims.

The dishwasher according to the invention comprising a washing container and devices for washing crockery using rinsing solution, comprises a sorption column containing reversibly dehydratable material which is connected to the washing container in an air-conductive manner, where the sorption column is used on the one hand for drying the crockery and on the other hand, the thermal energy used for desorption of the sorption column is used at least partly for heating the rinsing solution in the washing container and/or the crockery.

As a result of using reversibly dehydratable material having hygroscopic properties, e.g. zeolite, it is preferably not necessary to heat the items to be treated in the partial program step "clear rinse". It is certainly possible but not appropriate to heat the items to be treated in the partial program step preceding the partial program step "drying", especially the partial program step "clear rinse". Despite this, slight heating during the "clear rinsing", e.g. to 30° C. can be appropriate. This means a considerable saving of energy. As a result of the heating of the air which generally always occurs as a result of the released heat of condensation in the sorption column during the partial program step "drying", its moisture absorption capacity is increased on each passage through the sorption column which leads to an improvement in the drying result and shortening of the drying time. Additional heating of the air and thus of the crockery also using an additional heater in the "drying" partial program step is not normally required because the sorption column is heated to high temperatures, e.g. 150° C., by the heat of condensation of the water vapour and as a result, the air also reaches sufficiently high temperatures, e.g. 60°-70° C.

As is known, the reversibly dehydratable material is heated to very high temperatures for desorption for which thermal energy is required. In this case, the stored liquid emerges as hot water vapour. According to the invention, the water vapour is preferably guided into the treatment chamber of the appliance using an air stream and the air in the treatment chamber is thus heated and as a result, the rinsing solution and/or the crockery is also heated. The air which is passed through cools down whereby the water vapour contained therein condenses completely or partly. This preferably takes place as a closed air cycle. The introduction of the hot water vapour and the heated air into the treatment chamber during a partial program step using treatment liquid to be heated or which has possibly already been heated, is largely sufficient to adequately heat the treatment liquid. Thus, further heating can largely be dispensed with and, apart from the small amount of energy required to overcome the binding forces between water and reversibly dehydratable material, the thermal energy used for desorption can be also completely used for heating the treatment liquid, the rinsing solution and/or the crockery. In addition to the saving of energy, efficient cleaning of the items to be cleaned and treated is furthermore ensured.

The present invention provides a dishwasher which can be used to efficiently and economically clean and dry items to be washed in the washing container and to keep the associated energy expenditure as low as possible.

According to a preferred feature of the invention, air from the washing container and/or from the ambient air on the one hand during the partial program step "drying" and on the other hand preferably during a partial program step using rinsing liquid to be heated, preferably during the partial program step "cleaning" and/or pre-rinse", is passed through the sorption column and into the washing container, whereby the afore-mentioned advantages are used as prescribed in the dishwasher according to the invention.

In an especially advantageous fashion, the washing container has an outlet with a pipe to the sorption column, said pipe preferably having a check valve and then preferably an inlet valve to the ambient air in the direction of flow, and furthermore the washing container has an inlet with a pipe from the sorption column, a fan being located in the pipe to the sorption column, which introduces at least some of the air in the washing container or from the ambient air to the sorption column at least temporarily. In a preferably closed air system any exchange of contaminated air from the surroundings is completely eliminated, preventing any back contamination of the items to be treated. The fan can easily be controlled so that the use of the sorption column can be precisely controlled. In addition, the fan enhances the effect of the sorption column since the air to be passed through is conveyed more rapidly.

In a further embodiment, the sorption column has a container for the reversibly dehydratable material which makes it possible to exchange moisture and/or heat between the reversibly dehydratable material and the air surrounding it.

More appropriately, a preferably electric heating element is arranged for desorption of the reversibly dehydratable material.

According to a preferred embodiment, the heating element is located in the reversibly dehydratable material or in the pipe to the sorption column.

In another advantageous embodiment, the air which is introduced into the washing container via the inlet can be cooled so that the crockery is not damaged by high temperature.

According to an additional variant, a droplet separator is arranged at the inlet or the pipe is guided upwards over a partial area at the inlet so that no spray water reaches the sorption column via the pipe.

According to another embodiment, the thermal energy used for desorption can be stored in a heat storage device, e.g. a latent storage device, before being used for heating the rinsing solution and/or the crockery.

The invention is explained in detail hereinafter with reference to an exemplary embodiment of a dishwasher according to the invention shown in the drawings.

The single FIGURE is a schematic diagram showing a dishwasher 1 according to the invention, comprising a washing container 2 in which are located crockery baskets 3, 4 for arranging items to be washed, which are not shown.

According to the invention, the dishwasher 1 comprises a sorption column 10 containing reversibly dehydratable material 11, which is connected in a liquid-conducting manner to the washing container 2, said sorption column 10 being used on the one hand for drying and on the other hand for heating air which is passed through, as is explained in further detail below.

In the exemplary embodiment described, the washing container 2 has an outlet 5 in its upper area with a pipe 6 to the sorption column 10 and an inlet 8 with a pipe 7 from the sorption column 10 arranged in its lower area in the exemplary embodiment described. Located in the pipe 6 to the sorption column 10 is a fan 9 which supplies air from the washing container 2 to the sorption column 10.

In the preferably closed air system an exchange of contaminated air from the surroundings is completely eliminated, preventing any back contamination of the treated items.

For desorption of the reversibly dehydratable material 11 in the exemplary embodiment described an electric heating element 12 is arranged in the sorption column 10 in the exemplary embodiment described.

It is known that a dishwasher has a washing method whose program run generally consists of at least one partial program step "pre-rinse", a partial program step "clean", at least one partial program step "intermediate rinse", a partial program step "clear rinse" and a partial program step "dry". According to the invention and in the exemplary embodiment explained during the "drying" partial program step air from the washing container 2 is passed through the sorption column 10 and then back into the washing container 2. For this purpose the fan 9 is switched on. The air path is indicated by the arrows A, B and C. All the moisture is extracted by the reversibly dehydratable material 11 from the air introduced into the sorption column 10 by the fan 9 via the pipe 6. At the same time, the air is heated by the heat of condensation of the moisture or the water vapour which is released in the sorption column, whereby the moisture absorption capacity of the air advantageously increases. The very dry air now heated, for example to 40°-70° C., now re-enters the washing container via the pipe 8. The heated air introduced into the washing container 2 is completely dry and as a result of the higher temperatures, has a high absorption capacity for moisture. Said air rises upwards in the washing container 2 and absorbs the residual moisture on the items to be washed. It is now fed back to the sorption column 10, as described above.

As a result of using reversibly dehydratable material 11 in the partial program step "drying", heating of the items to be treated is not normally necessary in the "clear rinse" partial program step. This means a substantial saving of energy. As a result of the heating of the air, the moisture absorption capacity of the air is increased on each passage through the sorption column 10, which leads to an improvement in the drying result and a shortening of the drying time.

According to the invention and in the exemplary embodiment explained, air from the washing container 2 on the one hand during a partial program step using rinsing liquid to be heated or possibly already heated, preferably during the partial program step "cleaning" and/or pre-rinse", in the exemplary embodiment described during the partial program step "clean", is passed through the sorption column 10 and into the washing container 2. For this purpose, the fan 9 is switched on as has been explained above. The air path is indicated by the arrows A, B and C. Furthermore, the heater 12 is switched on for desorption of the reversibly dehydratable material 11.

It is known that the reversibly dehydratable material 11 is heated to very high temperatures for desorption. In this case, the stored liquid emerges as water vapour. The water vapour is fed into the washing container 2 by passing air by means of the fan 9 through the pipes 6, 8 in accordance with the air path of the arrows A, B, C and the air in the washing container is also heated. The introduction of the hot water vapour and the heated air into the washing container 2 during the partial program step "clean" in the treatment compartment is largely sufficient to adequately heat the rinsing solution and/or the crockery. Thus, further heating can largely be dispensed with and, apart from the small amount of energy required to overcome the binding forces between water and reversibly dehydratable material, the energy used for desorption can be also completely used for heating the rinsing solution and/or the crockery. In addition to the saving of energy, efficient cleaning of the items to be cleaned is furthermore ensured.

In a further embodiment, a check valve 13 and following this in the direction of flow of the air path according to arrow A, an inlet valve 14 is arranged to the ambient air, e.g. via a further pipe. In the example described above, the check valve 13 is open and the inlet valve 14 closed so that only air is sucked from the washing container 2 by the fan 9. By completely or partly closing the check valve 13 and completely or partly opening the inlet valve 14, ambient air is completely or partly extracted by the fan 9 and fed into the washing container via the pipe 7 and the inlet 8. For this purpose the washing container requires an outlet (not shown) so that this air from the surroundings can be released back to the surroundings again.

In another exemplary embodiment which is not shown, the outlet 5 is constructed so that as a result of an average enlargement from the outlet 5 to the pipe 6, the flow rate in the pipe 6 is lower than that in the outlet 5 so that no water droplets appear in the air (mist) in the pipe 6. In order to prevent the penetration of spray water into the pipe 6 and thus into the sorption column 10, either the pipe 6 can be guided upwards after the outlet 5 or a droplet separator (not shown) can be arranged at the outlet 5.

In another embodiment which is not shown the electrical heating element is not located in the sorption column 10 but in the pipe 6 between fan 9 and sorption column 10 in order to achieve uniform heating of the dehydratable material 11, e.g. zeolite. Excessive temperatures of the dehydratable material can thus advantageously be avoided in order to eliminate damage to the dehydratable material 11 resulting therefrom.

As already described above, the sorption column is preferably heated using a heater during a partial program step using treatment liquid to be heated to a very high temperature, e.g. 300° C. so that the sorption column delivers the absorbed water. During the "drying" partial program step the sorption column is also heated to high temperatures, e.g. 150-200° C. by the heat of condensation of the water vapour or the moisture.

As a result, the dry air introduced into the washing container or the air with water vapour can reach temperatures, e.g. 80° C. which can result in damage to crockery, e.g. plastic parts. In a further embodiment the air inlet temperature in the washing chamber must be lowered by means of cooling to such an extent that no damage occurs.

In the "drying" partial program step, for this purpose residual water is passed onto or around the inlet opening and the air flow is thereby cooled. In addition, the dry and warm air absorbs some of the water which leads to cooling of the air flow as a result of the evaporation cold. In a partial program step using the treatment liquid to be heated, heat exchange takes place with water vapour at the inlet opening as a result of the spray water and the air flow. The inlet opening is advantageously designed so that the air flow does not impact directly on the crockery and sufficient cooling of the air flow takes place as a result of the spray water.

In addition to the heating for heating the sorption column for desorption, hereinafter called air heating, in one variant a dishwasher according to the invention has a flow heater for the rinsing solution if this is not executed as a result of the present invention. If, in a further embodiment, heating is required in the "clear rinse" partial program step, this can either be achieved using the flow heater as is known from the prior art or using the air heating with the fan switched on. The advantage of heating using the air heating is that in the following "drying" partial program step the thermal energy stored in the sorption column can be used for drying.

In a further variant, during the heating phase of the partial program step "clear rinse" the fan is switched on when the air heating is switched off.

As a result, moist air is passed through the sorption column, which absorbs the moisture and the released condensation energy heats the sorption column and therefore also the air which is passed through. The condensation heat can thus be used to heat the rinsing solution and/or the crockery. The sorption column, e.g. using zeolite should be designed in this embodiment using a suitable large quantity of zeolite, for example, such that a good drying result can also be achieved in the "drying" partial program step.

The present invention provides a dishwasher which can be used to efficiently and economically clean and dry items to be washed in the washing container 2 and to keep the associated energy expenditure as low as possible.

The invention claimed is:

1. A method for treating crockery disposed in a washing container, comprising: subjecting crockery to at least a washing step, a rinsing step, and a drying step, wherein air is passed into contact with the crockery during at least one of the washing, rinsing, and drying steps and such air is thereafter guided to a sorption column communicated with the washing container for the passage of air between the sorption column and the washing container, the sorption container containing reversibly dehydratable material that operates to withdraw moisture from air during the passage of the air through the sorption column, crockery retained in the dishwasher being subjected to a drying step after having undergone a treatment step as a result of which moisture remains on the crockery with the drying step including passing air from the washing container through the sorption column, and the sorption column being subjected to thermal energy to effect desorption of the sorption column with the thermal energy being at least partly used for at least one of heating the rinsing solution in the washing container and heating the crockery, and the washing container having an outlet with a pipe to the sorption column, and the washing container has an inlet with a pipe from the sorption column, wherein a fan is located in the pipe to the sorption column, which introduces at least some of the air in the washing container or from the ambient air to the sorption column at least temporarily, wherein the drying step including passing air from the washing container through the sorption column includes passing air from a washing container having an outlet with a pipe and the pipe includes a check valve.

2. A method for treating crockery disposed in a washing container, comprising: subjecting crockery to at least a washing step, a rinsing step, and a drying step, wherein air is passed into contact with the crockery during at least one of the washing, rinsing, and drying steps and such air is thereafter guided to a sorption column communicated with the washing container for the passage of air between the sorption column and the washing container, the sorption container containing reversibly dehydratable material that operates to withdraw moisture from air during the passage of the air through the sorption column, crockery retained in the dishwasher being subjected to a drying step after having undergone a treatment step as a result of which moisture remains on the crockery with the drying step including passing air from the washing container through the sorption column, and the sorption column being subjected to thermal energy to effect desorption of the sorption column with the thermal energy being at least partly used for at least one of heating the rinsing solution in the washing container and heating the crockery, and the washing container having an outlet with a pipe to the sorption column, and the washing container has an inlet with a pipe from the sorption column, wherein a fan is located in the pipe to the sorption column, which introduces at least some of the air in the washing container or from the ambient air to the sorption column at least temporarily, wherein the drying step including passing air from the washing container through the sorption column includes passing air from a washing container having, in the direction of flow, an inlet valve to the ambient air.

* * * * *